US005198722A

United States Patent [19]

Brabham et al.

[11] Patent Number: 5,198,722

[45] Date of Patent: Mar. 30, 1993

[54] HIGH-PRESSURE DISCHARGE LAMP WITH END SEAL EVAPORATION BARRIER

[75] Inventors: Dale E. Brabham, Elmira; Geert Van Bockstal, Lakeville, both of N.Y.

[73] Assignee: North American Philips Corporation, New York, N.Y.

[21] Appl. No.: 607,428

[22] Filed: Oct. 31, 1990

[51] Int. Cl.[5] ..... H01J 61/36
[52] U.S. Cl. ..... 313/623; 313/625
[58] Field of Search ..... 313/623, 625

[56] References Cited

U.S. PATENT DOCUMENTS 4,721,886 1/1988 Oomen et al. ..... 313/625 X

*Primary Examiner*—Sandra L. O'Shea
*Attorney, Agent, or Firm*—Norman N. Spain

[57] ABSTRACT

A high pressure discharge lamp having a translucent sintered aluminum oxide envelope, has a tubular current lead-in member, secured in a gas tight manner by an end-plug secured to the current lead-in member by a magnesium oxide containing glass seal and an aluminum oxide disk bonded to the outer surface of the end plug and extending over the glass seal.

4 Claims, 3 Drawing Sheets

J4 02 P1

HIGH-PRESSURE DISCHARGE LAMP WITH END SEAL EVAPORATION BARRIER

BACKGROUND OF THE INVENTION

The instant invention relates to a high-pressure gas discharge lamp having an envelope enclosing a discharge space consisting of a translucent densely sintered aluminum oxide, at least one tubular current lead-in member secured in a gas-type manner in the envelope and an end plug having an aperture for the current lead-in member fused to a cylindrical part of the envelope.

In this lamp, the end plug is sealed to the current lead-in member by a glass seal.

Such a lamp generally contains an ionizable filling which frequently is a mixture of mercury, a rare gas and an alkali metal.

A lamp of this type is disclosed in Oomen U.S. Pat. No. 4,721,886. As shown in this patent, a gas-tight seal is provided between the end plug and the current lead-in member by a magnesium oxide containing glass sealing ceramic provided in a capillary space between the end plug and the current lead-in member.

While the magnesium oxide containing glass seal provides a satisfactory gas-tight construction, it has been found that when the lamp is operated so as to provide a high temperature to where the current lead-in member enters through the end plug (for example 750° C. produced during operation of a 150 W lamp), magnesium metal can evaporate from the seal. It is found that in such cases, the magnesium provides a coating on the inner surface of the envelope thereby significantly reducing the lumen output of the lamp. This phenomenon increases with time thereby diminishing the useful life of the lamp.

SUMMARY OF THE INVENTION

An object of this invention is to provide a high-pressure gas discharge lamp of the type described in which leakage or evaporation of magnesium from the seal provided between the end plug and the current lead-in member is entirely or almost entirely eliminated. This and other objects of the invention will be apparent from the description of the invention that follows.

According to the invention, it has been found that leakage or evaporation of magnesium from the glass seal provided between the current lead-in member and the end plug may be eliminated or almost entirely eliminated by positioning a thin disc-shaped barrier member formed of a high temperature material, provided with an aperture for the current lead-in member, on the outer surface of the end plug extending over this outer surface at least beyond the glass seal provided between the end plug and the current lead-in member and sealed to the surface of the end plug.

Further, according to the invention, this barrier member is provided on the end plug after the magnesium oxide containing glass frit has been provided in a capillary space between the current lead-in member and the end plug but prior to the formation of the glass seal by heating of the glass frit. Additionally, according to the invention, after positioning the barrier member, the assembly is heated to a temperature sufficient to melt the glass frit and the barrier member. As a result, the glass frit is caused to melt and form a magnesium containing glass seal between the current lead-in member and the plug and the barrier member is caused to melt and bond to the outer surface of the resultant glass seal.

Because of the presence of the covering barrier member evaporation of magnesium from the glass seal is almost entirely prevented during operation.

DETAILED DESCRIPTION OF THE INVENTION

Figure 1:
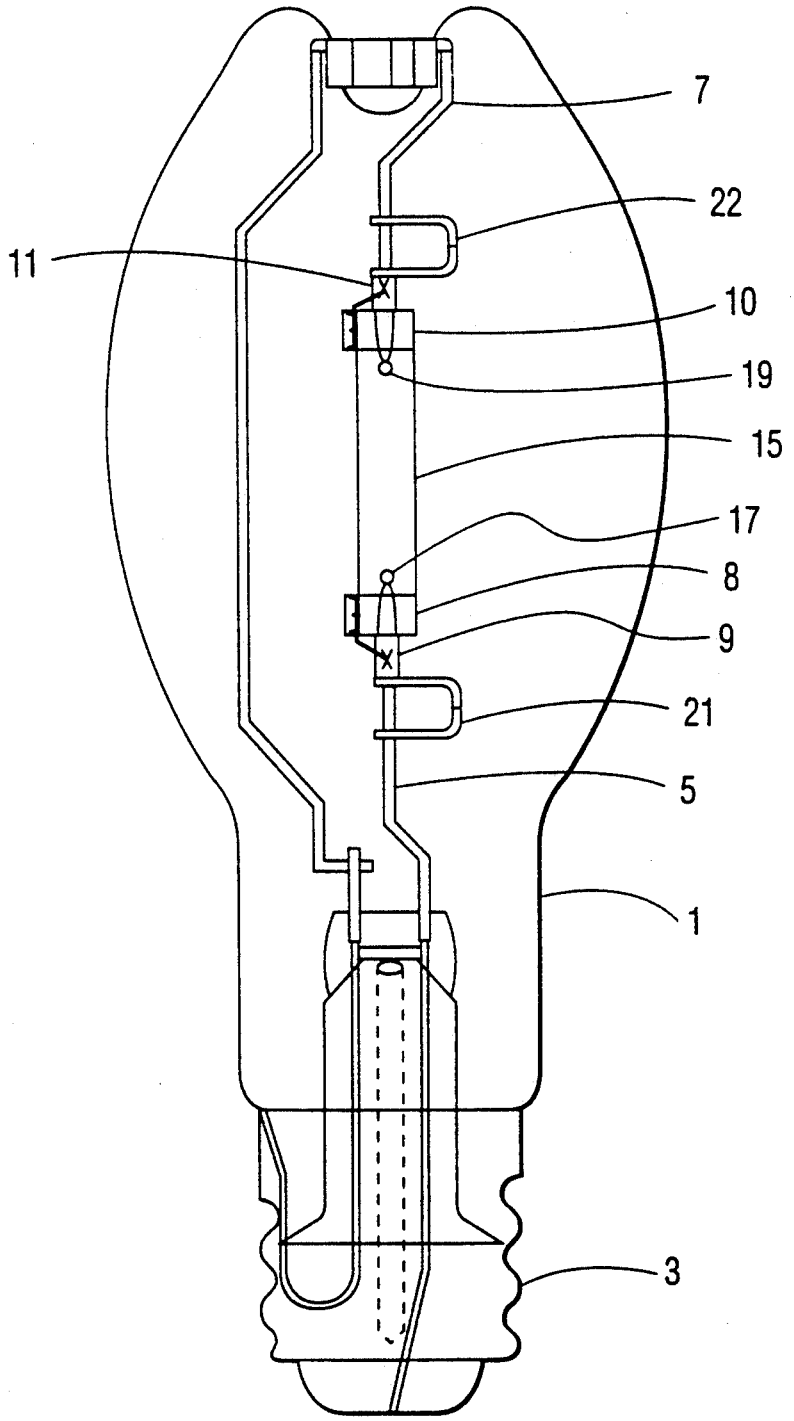
FIG. 1 is a side elevation of a lamp of the invention with the outer bulb broken away.

While the barrier member may be formed of any high temperature resistant material, it preferably is formed of aluminum oxide. The thickness of the barrier member may range from about 0.1 mm to 1.0 mm or more. The diameter of the barrier is such so as to provide a seal extending at least over the glass seal provided between the lead-in member and the end plug.

The current lead-in member preferably is formed of niobium.

In general, the discharge space which is enclosed by the envelope, is filled with mercury, a rare gas and alkali metal. An example of the rare gas which may be employed is xenon. An example of an alkali metal that may be employed is sodium. The envelope is cylindrically shaped in the area of the tubular current lead-in member and frequently may be tubular in form.

Usually, the envelope is formed of translucent, densely sintered aluminum oxide.

For a more complete understanding, the invention will now be described with reference to the figures of the drawing.

A lamp of the invention, as shown in FIG. 1, comprises a glass outer bulb 1 provided with a lamp cap 3 and having current conducting members 5 and 7 extending from tubular shaped niobium current lead-in members 9 and 11 extending into the discharge space enclosed within tubular shaped envelope 15. This tubular shaped envelope 15 is formed of translucent, densely sintered aluminum oxide. The current lead-in members 9 and 11 are each provided with electrodes 17 and 19 between which a discharge extends when the lamp is in operative condition.

Heat shields 8 and 10 formed of bands of niobium or tantalum surround the ends of envelope 15.

A satisfactory electrical contact between the two current lead-in members 9 and 11 and conducting members 5 and 7 is provided by niobium wire 21 and 22. Subsequent to the sealing of one of the current lead-in members, but prior to the sealing of the other current lead-in member to the envelope the discharge space is filled with 30 mg of mercury, 10 mg of sodium and 40 torr of xenon.

Figure 3:
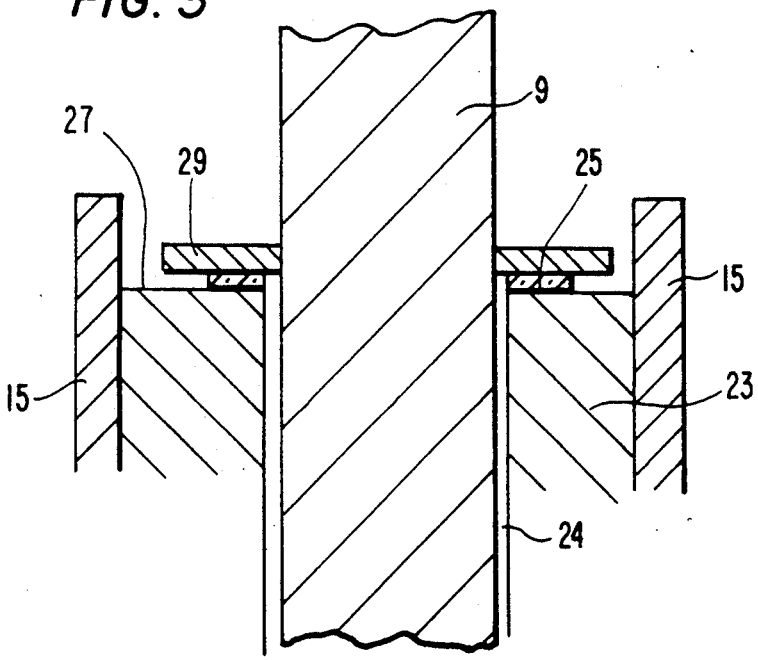
FIG. 3 is a longitudinal sectional view showing a step in the formation of the end of the envelope shown in FIG. 2.
Figure 2:
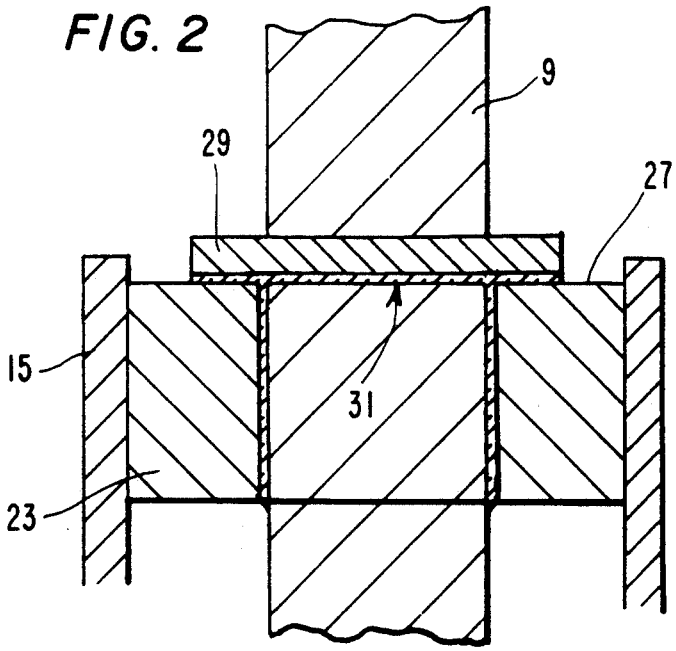
FIG. 2 is a longitudinal sectional view of an end of the envelope enclosing the discharge space shown in FIG. 1.

The sealing of the niobium current lead-in members into the discharge space provided within the envelope 15 will now be described with reference to FIG. 2 and FIG. 3 of the drawing.

End plug 23 formed of densely sintered aluminum oxide provided with an aperture for current lead-in member 9 having a diameter so as to provide only a capillary space 24 for current lead-in member 9 is positioned in a recessed position within the end of envelope 15 so as to bear against the inner surface of envelope 15 and is sealed, by sintering, to envelope 15.

A thin disc-shaped member 25 for forming a glass seal between the lead-in member 9 and the end plug 23 and having an aperture for the lead-in member 9 is provided on the upper surface 27 of the end plug 23. This disc-shaped sealing member 25 is formed of a magnesium oxide containing glass frit having the composition 51.4% CaO, 33.1% $Al_2O_3$, 9.5% MgO, 4.2% BaO and 1.8% $B_2O_3$.

A 1.0 mm thick disc-shaped barrier member 29, extending beyond the sealing member 25 and having an aperture for the lead-in member 9, is positioned over the sealing member 25. The resultant assembly is then heated to a temperature sufficient to cause the sealing member 25 to enter into the capillary space 24 between the lead-in member 9 and the end plug 23 and form a glass seal 31 between these two parts, and to cause barrier member 29 to form a seal on the outer surface of end plug 23 extending over glass seal 31.

After introduction of mercury sodium and xenon into the discharge space, the other lead-in member 11 is sealed into the other end of the envelope 15 in a similar manner.

Lamps of the invention and lamps lacking the evaporation barrier were subjected to 2,000 hours of burning.

The results are shown in the following tables and FIG. 4 of the drawing:

TABLE I

| LAMPS WITH FRIT EVAPORATION BARRIER | | | |
|---|---|---|---|
| Lamp No. | Time | Lumens | Maint |
| P1 | 0 | 25,131 | 97.0 |
| | 100 | 25,849 | 100.0 |
| | 1000 | 24,557 | 94.8 |
| | 2000 | 23,353 | 90.2 |
| | 4000 | 22,218 | 86.0 |
| P2 | 0 | 23,559 | 93.7 |
| | 100 | 25,185 | 100.0 |
| | 1000 | 25,735 | 102.2 |
| | 2000 | 25,080 | 99.6 |
| | 4000 | 23,674 | 94.0 |

TABLE II

| LAMPS WITHOUT A FRIT EVAPORATION BARRIER | | | |
|---|---|---|---|
| Lamp No. | Time | Lumens | Maint |
| J1 | 0 | 24,860 | 97.4 |
| | 20 | 25,532 | 100.0 |
| | 100 | 25,526 | 100.0 |
| | 1000 | 23,152 | 90.7 |
| | 2000 | 21,292 | 83.4 |
| | 4000 | 19,424 | 76.1 |
| J4 | 0 | 23,347 | 94.2 |
| | 20 | 25,021 | 100.9 |

TABLE II-continued

| LAMPS WITHOUT A FRIT EVAPORATION BARRIER | | | |
|---|---|---|---|
| Lamp No. | Time | Lumens | Maint |
| | 100 | 24,791 | 100.6 |
| | 1000 | 23,465 | 94.7 |
| | 2000 | 21,536 | 86.9 |
| | 4000 | 20,280 | 81.8 |
| O2 | 0 | 27,355 | 101.3 |
| | 20 | 27,289 | 101.1 |
| | 100 | 27,000 | 100.0 |
| | 1000 | 25,942 | 96.1 |
| | 2000 | 24,249 | 89.8 |
| | 4000 | 23,015 | 85.7 |
| K3 | 0 | 23,024 | 95.6 |
| | 20 | 24,254 | 100.7 |
| | 100 | 24,093 | 100.0 |
| | 1000 | 22,934 | 95.2 |
| | 2000 | 21,118 | 87.6 |

In the tables, "Time" is the hours of lamp burning; "Maint" is the percentage of lumen maintenance as compared the lumen output at 100 hours of burning; "volts" are lamp volts.

The tables show that lamps with the frit evaporation barrier member 29 exhibit a better lumen maintenance at 4000 hours than lamps without a barrier member 29. The tables also show the drop in maintenance from 1000 hrs. to 4000 hrs. of burning is reduced by using barrier member 29 as shown by lamps P1 and P2.

Figure 4:
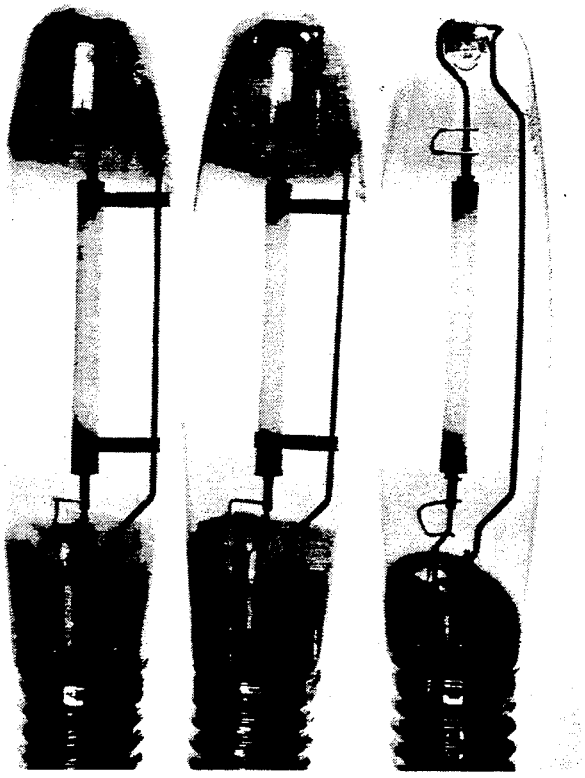
FIG. 4 is a photograph of two lamps of the prior art and one of the invention after 2000 hours of burning.

FIG. 4 shows a photograph of lamps burned for 2000 hours.

Lamp J4 and O2 have no frit evaporation barrier and show blackening at the outer bulb.

Lamp P1 that has a member 29, an evaporation barrier, shows a lot less blackening, as can be seen from the photograph, and therefore has a better lumen maintenance compared to the lamps lacking the evaporation barrier.

What is claimed is:

1. A high pressure gas discharge lamp having an envelope enclosing a discharge space and containing an ionizable filling and consisting of translucent densely sintered aluminum oxide, at least one tubular current lead-in member secured in a gas-tight manner in said envelope, said envelope having a cylindrical part in the area of the current lead-in member, an end plug having an aperture for said current-lead-in member and consisting of translucent densely sintered aluminum oxide, said end plug forming an end plug for said envelope bearing against, and fused to, the cylindrical part of said envelope and said end plug sealed to said current lead-in member by a magnesium oxide containing glass seal provided in said aperture and a disc-like barrier member, consisting of aluminium oxide, positioned on the outer surface of said end-plug, extending over said glass seal an bonded to said outer surface of said end plug.

2. The lamp of claim 1 wherein the lead-in member is formed of niobium.

3. The lamp of claim 2 wherein mercury, a rare gas and an alkali metal are provided in the discharge space.

4. The lamp of claim 3 wherein the alkali metal is sodium and the gas is xenon.

* * * * *